US007988798B2

(12) United States Patent
Ozaki et al.

(10) Patent No.: US 7,988,798 B2
(45) Date of Patent: Aug. 2, 2011

(54) AMORPHOUS ALLOY RIBBON SUPERIOR IN MAGNETIC CHARACTERISTICS AND LAMINATION FACTOR

(75) Inventors: Shigekatsu Ozaki, Kitakyushu (JP); Takeshi Imai, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 299 days.

(21) Appl. No.: 12/223,900

(22) PCT Filed: Feb. 14, 2007

(86) PCT No.: PCT/JP2007/053120
§ 371 (c)(1),
(2), (4) Date: Aug. 11, 2008

(87) PCT Pub. No.: WO2007/094502
PCT Pub. Date: Aug. 23, 2007

(65) Prior Publication Data

US 2010/0163136 A1 Jul. 1, 2010

(30) Foreign Application Priority Data

Feb. 17, 2006 (JP) ..... 2006-040664

(51) Int. Cl.
*H01F 1/053* (2006.01)
*H01F 1/14* (2006.01)

(52) U.S. Cl. ..... 148/304; 148/306

(58) Field of Classification Search ..... None
See application file for complete search history.

(56) References Cited

U.S. PATENT DOCUMENTS

| | | | | |
|---|---|---|---|---|
| 4,834,814 | A * | 5/1989 | Hasegawa et al. | 148/304 |
| 4,834,816 | A * | 5/1989 | Hasegawa et al. | 148/304 |
| 2006/0191602 | A1 * | 8/2006 | Hasegawa et al. | 148/304 |

FOREIGN PATENT DOCUMENTS

| | | |
|---|---|---|
| JP | 56-119556 | 9/1981 |
| JP | 60-177936 | 9/1985 |
| JP | 60-007902 | 1/1994 |
| JP | 7-113151 | 5/1995 |
| JP | 9-143640 | 6/1997 |
| JP | 9-263914 | 10/1997 |
| JP | 9-268354 | 10/1997 |
| JP | 09-268354 | 10/1997 |
| JP | 10-323742 | 12/1998 |
| JP | 2000-054089 | 2/2000 |
| JP | 2000-328206 | 11/2000 |
| JP | 2005-256104 | 9/2005 |

OTHER PUBLICATIONS

International Search Report dated May 1, 2007 issued in corresponding PCT Application No. PCT/JP2007/053120.

* cited by examiner

*Primary Examiner* — John P Sheehan
(74) *Attorney, Agent, or Firm* — Kenyon & Kenyon LLP

(57) ABSTRACT

The present invention provides an amorphous alloy ribbon superior in magnetic characteristics and lamination factor by defining the slip property of the amorphous alloy ribbon surface in a specific range, that is, an amorphous alloy ribbon superior in magnetic characteristics and lamination factor produced by the single roll method, characterized in that the slip property of the ribbon surface satisfies the following equation:

$$0.1 \leqq F = P/M \leqq 1.0$$

where, F is the slip friction coefficient, P is the force pulling the intermediate part of the amorphous ribbon when applying weight from above to three amorphous ribbons stacked together, and M is the load applied from the top of the amorphous ribbon (5 kg).

1 Claim, 2 Drawing Sheets

AMORPHOUS ALLOY RIBBON SUPERIOR IN MAGNETIC CHARACTERISTICS AND LAMINATION FACTOR

TECHNICAL FIELD

The present invention relates to an amorphous alloy ribbon superior in magnetic characteristics and lamination factor used for an iron core of a power transformer, high frequency transformer, etc.

BACKGROUND ART

As the technical problem when using an amorphous alloy ribbon as the material for the iron core of a power transformer, high frequency transformer, etc., the fact that the amount of use of materials at the time of production of the transformer, for example, the iron core and copper wire, becomes greater and the production cost becomes higher than the case of use of silicon steel sheet can be mentioned. This is because most amorphous alloy ribbons have a small saturation magnetization force and reduce the design magnetic flux density at the transformer and, as a result, the cross-sectional area of the iron core becomes larger.

This amorphous alloy ribbon is most generally produced by the single roll method of ejecting a molten alloy onto the surface of a rotating cooling roll from a rectangular orifice for rapid cooling and solidification. The important things in the method of production of an amorphous alloy ribbon by the single roll method are the uniformity of the sheet thickness and surface properties. The quality of the surface properties governs not only the magnetic characteristics of the amorphous alloy ribbon when used as a single sheet, but also the characteristics of the core in the case of use of amorphous ribbons stacked together such as with the core of a power transformer etc. When the surface properties deteriorate, the drop in the lamination factor causes enlargement of the core, the deterioration of the magnetic characteristics causes an increase in the Watt loss and noise, etc. Therefore, various proposals have been made regarding the surface properties of said amorphous alloy ribbon.

For example, in Japanese Patent Publication (A) No. 6-7902, an amorphous metal ribbon having a surface roughness of the roll non-contact surface of an Rz of 1.5 μm or less is proposed, while in Japanese Patent Publication (A) No. 2000-328206, a soft magnetic alloy ribbon with a width of air pockets at the roll surface of 35 μm or less, a length of 150 μm or less, an average roughness of an Ra of 0.5 μm or less, and improved soft magnetic characteristics is proposed. Furthermore, in Japanese Patent Publication (A) No. 2000-54089, an Fe-based amorphous alloy comprising an Fe—Si—B-based amorphous alloy ribbon reduced in area ratio of the air pockets on the surface of the roll surface side to 20% or less to improve the Watt loss characteristics is proposed, in Japanese Patent Publication (A) No. 9-143640, an Fe—Si—B—C-based wide amorphous alloy ribbon for power transformer iron core use cast in an atmosphere including $CO_2$ gas in 40 vol % or more and having a centerline average roughness Ra of the contact surface with the roll of 0.7 μm or less is proposed, and in Japanese Patent Publication (A) No. 9-268354, a low B amorphous alloy superior in magnetic characteristics made of a low B content Fe—Si—B-based amorphous alloy and having a sheet thickness of 15 to 25 μm and a surface roughness Ra of 0.8 μm or less is proposed.

However, the arts proposed in these patent documents were developed taking note of, as a guideline for improvement of the magnetic characteristics, the surface roughness or shape of air pockets of the amorphous alloy ribbon, that is, local physical characteristics of the amorphous alloy ribbon, and were not developed from the viewpoint of the slip property of the ribbon surface governing the magnetic characteristics, lamination factor, workability, etc. when used stacked as in a core of a power transformer etc.

DISCLOSURE OF THE INVENTION

The present invention provides an amorphous alloy ribbon superior in magnetic characteristics and lamination factor by defining the slip property of the amorphous alloy ribbon surface to a specific range.

The present invention was made to solve the above problem and provides an amorphous alloy ribbon produced by the single roll method, that is, an amorphous alloy ribbon superior in magnetic characteristics and lamination factor produced by the single roll method, characterized in that the slip property of the ribbon surface satisfies the following equation:

$$0.1 \leqq F = P/M \leqq 1.0$$

where, F is the slip friction coefficient, P is the force pulling the intermediate part of the amorphous ribbon when applying weight from above to three steel ribbons stacked together, and M is the load applied from the top of the amorphous ribbon (5 kg).

BEST MODE FOR CARRYING OUT THE INVENTION

There are the following methods for controlling the slip property of an amorphous alloy ribbon:

1) Adjusting the cooling roll finished roughness. (Finding the relationship between the roughness of the abrasive paper and the roll surface roughness after polishing in advance and adjusting the cooling roll before casting to the desired roughness by polishing.)

2) Polishing the cooling roll during casting on-line to adjust the roughness.

3) Adjusting the clearance between the casting nozzle and the cooling roll to adjust the number and size of the air pockets formed in the amorphous alloy ribbon (when using the single roll method to produce an amorphous alloy ribbon, the fine recesses formed by air at the surface of the molten alloy cooled by the cooling roll) (if becoming extremely large, the slip property deteriorates).

4) Adjusting the ejection pressure of the molten steel from the casting nozzle (if making the ejection pressure extremely small, the slip property deteriorates).

5) Adjusting the circumferential speed of the cooling roll (if making the circumferential speed of the cooling roll extremely small, the slip property deteriorates).

Figure 1:
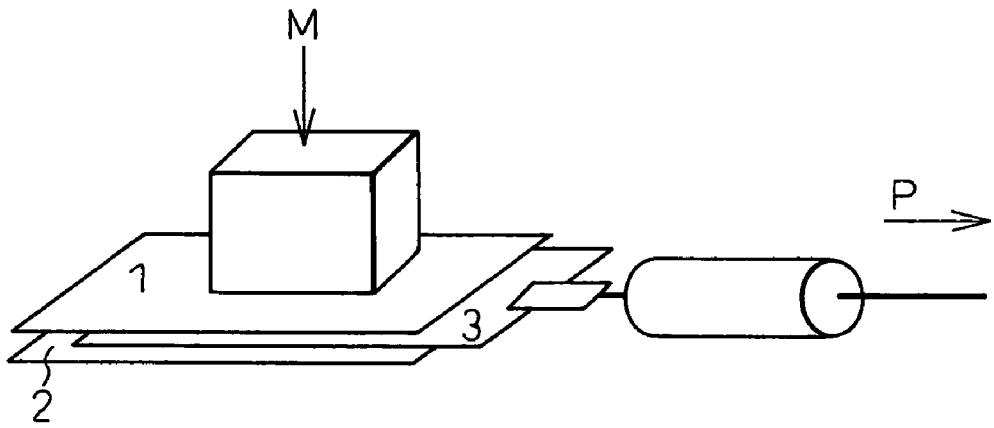
FIG. 1 is a schematic view of the configuration of a measurement system for the slip friction coefficient in the present invention.

To judge said slip property, as shown in FIG. 1, three amorphous ribbon samples 3 cut to 60 mm×60 mm from the cast amorphous ribbon are stacked together between surface polished 80 mm×100 mm clamping plates 1, 2 (ordinary steel plates with surface roughness Ra of not more than 0.4μ) and placed on a surface table a load M weight 4 of 5 kg is applied on the clamping plate 1, and the amorphous ribbon sample at the center sandwiched between the top and bottom amorphous ribbon samples is pulled out. The pullout force P when pulling it out is measured by a spring balance 5 to find the slip friction coefficient (F).

The inventors investigated amorphous ribbons able to be continuously cast and discovered a relationship between the slip friction coefficient (F), used to evaluate the surface properties from the viewpoint of the slip property, and the magnetic characteristics and lamination factor.

Figure 2:
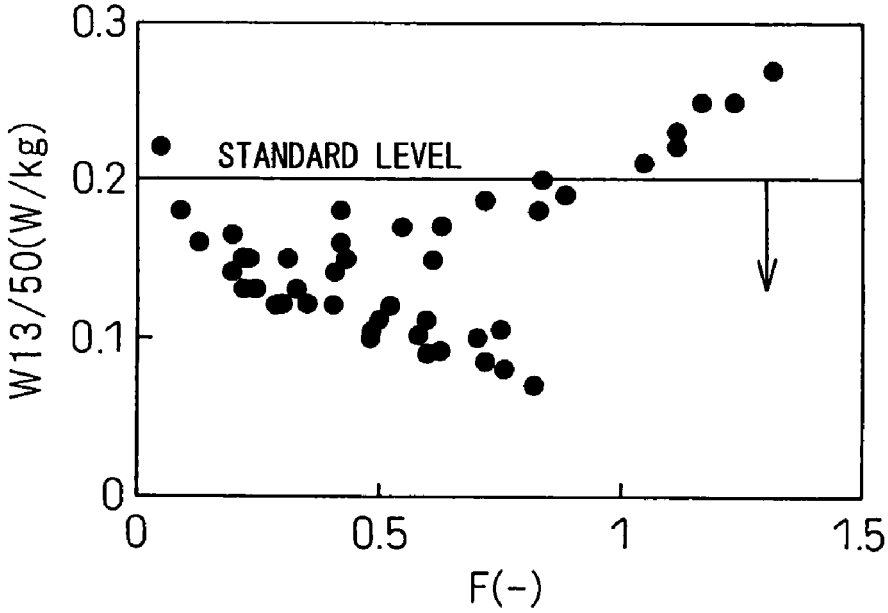
FIG. 2 is a view showing the relationship between the Watt loss and slip friction coefficient.
Figure 3:
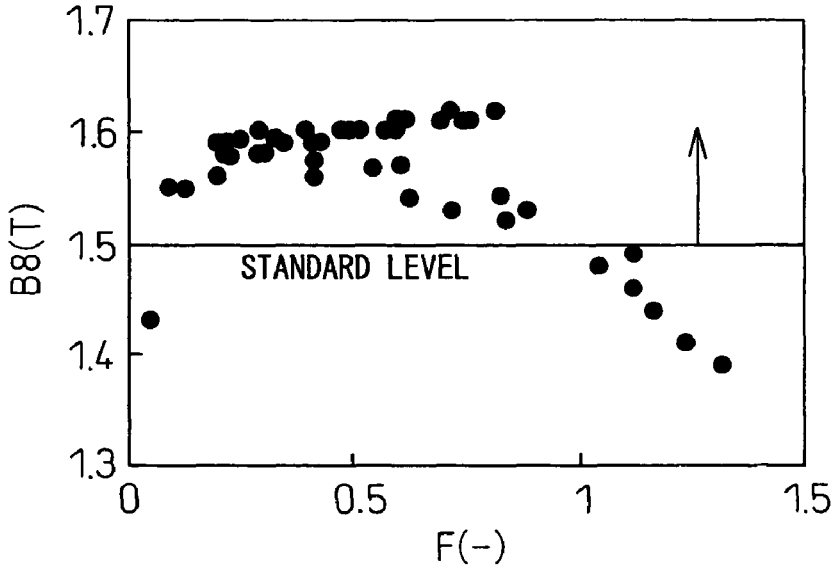
FIG. 3 is a view showing the relationship between the magnetic flux density and the slip friction coefficient.
Figure 4:
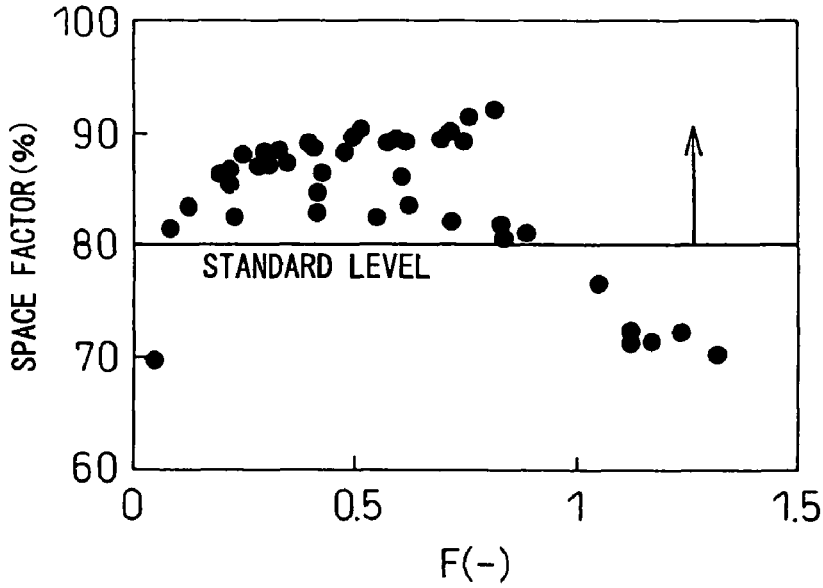
FIG. 4 is a view showing the relationship between the lamination factor and the slip friction coefficient.

As shown in FIG. 2 and FIG. 3, when the magnetic characteristics are good, this slip friction coefficient (F) is close to 1 (FIG. 2 shows the relationship between the Watt loss at the time of excitation at 50 Hz and 1.3 T (W13/50) and the slip friction coefficient, while FIG. 3 shows the relationship between the magnetic flux density (B8) under a magnetic field of 800 A/m and the slip friction coefficient). As the magnetic characteristics deteriorate, the slip friction coefficient (F) also becomes smaller, but if further deteriorating, conversely the F becomes larger. Further, as shown in FIG. 4, with the lamination factor as well, in the same way as the magnetic characteristics, when the lamination factor is good, this slip friction coefficient (F) is close to 1. As the lamination factor falls, the slip friction coefficient (F) also becomes small, but if it further falls, conversely the F tends to become larger.

The inventors studied the magnetic characteristics necessary for application to transformers etc. and as a result discovered that the Watt loss has to be W13/50≦0.2 W/kg, preferably W13/50≦0.15 W/kg, the magnetic flux density has to be B8≧1.5 T, preferably B8≧1.52 T, and lamination factor≧80%. They defined satisfying these characteristics as the criteria for making an amorphous ribbon a good amorphous ribbon.

The range of the slip friction coefficient (F) for satisfying the ribbon characteristics, according to the above investigation by the inventors, was discovered to be 0.1≦F≦1.0, more preferably 0.1≦F≦0.8.

It is preferable to decide on the conditions for realizing a slip property (slip friction coefficient) satisfying the above-mentioned magnetic characteristics and lamination factor by analyzing past casting data etc. and set them before casting. That is, when measuring the slip friction coefficient of the ribbon after casting under the conditions prescribed in the present invention and the target value cannot be obtained, it is sufficient to change one or a combination of the conditions of the clearance between the casting nozzle and cooling roll, the casting temperature, the casting speed, the atmosphere, the ejection pressure, etc.

For example, it is possible to set the slip friction coefficient to the above value by using #800 or higher abrasive paper to finish the surface roughness of the cooling roll to an Ra value of 0.2 μm before production, setting the clearance between the casting nozzle and cooling roll to 200 μm, and ejecting 1320° C. molten alloy in the air by a 0.024 MPa ejection pressure from the nozzle to a cooling roll rotating at a casting speed of 25 m/s.

EXAMPLES

Next, examples of the present invention will be explained, but the conditions of the examples are examples of conditions employed for confirming the workability and effects of the present invention. The present invention is not limited to these conditions. The present invention can employ various conditions so long as not departing from the gist of the present invention and achieving the object of the present invention.

An iron-based alloy comprising, by at %, Fe: 80.5%, B: 15.2%, Si: 3.1%, C, 1.1%, and a balance of unavoidable impurities was melted and ejected onto an internal water-cooling type copper alloy cooling roll having a roll diameter ϕ of 1198 mm, a width of 250 mm, and a thickness of 19 mm through a ceramic nozzle given a rectangular slit of 170 mm×0.85 mm to cast a 170 mm width amorphous ribbon. The casting was performed in the air, the molten alloy temperature was set to 1320° C., the casting speed was set to 25 m/s, the ejection pressure of the molten alloy was set to 0.024 MPa, and the Ra value of the finished roughness of the cooling roll before casting the amorphous ribbon and the clearance between the nozzle and cooling roll were changed to obtain different amorphous ribbons. Their slip friction coefficients were measured under the conditions prescribed in the present invention. Further, the magnetic characteristics and lamination factors of said amorphous ribbons were measured at parts adjoining the parts where the slip friction coefficients was measured. For the magnetic characteristics, using a single sheet magnetic measurement system, each ribbon was annealed in a magnetic field at 360° C. for 1 hour in a nitrogen atmosphere, then measured for the Watt loss at the time of excitation by 50 Hz and 1.3 T (W13/50) and the magnetic flux density (B8) under a magnetic field of 800 A/m. Further, the lamination factor was found by cutting a ribbon of a width of 0.17 m into 20 sheets of lengths of 0.12 m, measuring their weights W (kg), stacking them with their top, bottom, left, and right ends aligned in the same directions, measuring the thickness at 10 mm intervals in the width direction by a micrometer, and entering the maximum value T(m) of the measured thickness and the density D (kg/cm$^3$) of the ribbon into the following equation:

$$\text{Lamination factor (\%)} = W/(0.17\times0.12\times T\times D).$$

The results are shown in Table 1.

TABLE 1

| | | Production conditions | | | | | |
|---|---|---|---|---|---|---|---|
| Class | No. | Cooling roll finished roughness Ra (μm) | Clearance between nozzle and cooling roll (μm) | Slip friction coefficient F (–) | Watt loss W13/50 (W/kg) | Magnetic flux density B8 (T) | Lamination factor (%) |
| Inv. | 1 | 0.12 | 200 | 0.76 | 0.08 | 1.61 | 91.2 |
| ex. | 2 | 0.19 | 200 | 0.6 | 0.09 | 1.61 | 89.2 |
| | 3 | 0.22 | 200 | 0.58 | 0.102 | 1.6 | 88.9 |
| | 4 | 0.23 | 250 | 0.48 | 0.103 | 1.6 | 88.2 |
| | 5 | 0.47 | 250 | 0.22 | 0.13 | 1.59 | 85.3 |
| | 6 | 0.51 | 250 | 0.13 | 0.16 | 1.55 | 82.2 |

TABLE 1-continued

| Class | No. | Production conditions: Cooling roll finished roughness Ra (μm) | Production conditions: Clearance between nozzle and cooling roll (μm) | Slip friction coefficient F (−) | Watt loss W13/50 (W/kg) | Magnetic flux density B8 (T) | Lamination factor (%) |
|---|---|---|---|---|---|---|---|
| | 7 | 0.62 | 250 | 0.42 | 0.18 | 1.53 | 81.7 |
| | 8 | 0.82 | 250 | 0.84 | 0.2 | 1.52 | 80.4 |
| C. | 9 | 0.92 | 300 | 1.12 | 0.23 | 1.49 | 72.2 |
| ex. | 10 | 1.48 | 300 | 1.17 | 0.25 | 1.44 | 71.3 |
| | 11 | 1.56 | 300 | 1.24 | 0.25 | 1.41 | 71.1 |
| | 12 | 2.21 | 300 | 1.32 | 0.27 | 1.39 | 70.2 |

In Invention Example Nos. 1 to 8, it is confirmed that the slip friction coefficient is in the range defined by the present invention, all of the Watt loss, magnetic flux density, and lamination factor satisfy the standard values, and good characteristics are exhibited.

On the other hand, Comparative Example Nos. 9 to 12 are examples not satisfying the range of the slip friction coefficient defined in the present invention and did not satisfy the standard values in all of the Watt loss, magnetic flux density, and lamination factor.

INDUSTRIAL APPLICABILITY

According to the present invention, it is possible to prevent a deterioration or drop of not only the magnetic characteristics and the lamination factor of amorphous alloy ribbon as single sheets, but also the magnetic characteristics and lamination factor when the amorphous ribbon is used stacked up such as with the core of a power transformer, it is possible to prevent enlargement of the core, Watt loss, noise, etc., the production yield of the amorphous alloy ribbon is improved, and further the variation in quality is reduced in applications used stacked up such as in cores. Further, the surface properties of the amorphous alloy ribbon can be evaluated by the simple means of finding the slip friction coefficient (F).

The invention claimed is:

1. An Fe-based amorphous alloy ribbon superior in magnetic characteristics and lamination factor produced by a single roll method, characterized in that a slip property of the ribbon surface satisfies the following equation:

$$0.1 \leqq F = P/M \leqq 1.0$$

where, F is the slip friction coefficient, P (kg-f) is the force for pulling out a middle amorphous alloy ribbon from a stack of three amorphous alloy ribbons when applying a load M of 5 kg-f on top of the stacked three amorphous alloy ribbons.

* * * * *